US010704402B2

(12) United States Patent
Brewer et al.

(10) Patent No.: US 10,704,402 B2
(45) Date of Patent: Jul. 7, 2020

(54) GAS TURBINE ENGINE WITH A TRANSITION DUCT AND CORRESPONDING METHOD OF MANUFACTURING A TRANSITION DUCT

(71) Applicant: Siemens Aktiengesellschaft, Munich (DE)

(72) Inventors: Steven Brewer, Lincoln (GB); Ghenadie Bulat, Lincoln (GB); Robert Parke, Darley Abbey (GB)

(73) Assignee: Siemens Aktiengesellschaft, Munich (DE)

( * ) Notice: Subject to any disclaimer, the term of this patent is extended or adjusted under 35 U.S.C. 154(b) by 367 days.

(21) Appl. No.: 15/315,772

(22) PCT Filed: Jun. 1, 2015

(86) PCT No.: PCT/EP2015/062061

§ 371 (c)(1),
(2) Date: Dec. 2, 2016

(87) PCT Pub. No.: WO2015/197308

PCT Pub. Date: Dec. 30, 2015

(65) Prior Publication Data

US 2017/0107833 A1 Apr. 20, 2017

(30) Foreign Application Priority Data

Jun. 25, 2014 (EP) ..... 14173945

(51) Int. Cl.

| | |
|---|---|
| ***F02D 9/00*** | (2006.01) |
| ***F01D 9/02*** | (2006.01) |
| ***F01D 25/08*** | (2006.01) |

(52) U.S. Cl.

CPC ..... *F01D 9/023* (2013.01); *F01D 25/08* (2013.01); *F05D 2240/35* (2013.01); *F05D 2260/231* (2013.01); *F05D 2300/611* (2013.01)

(58) Field of Classification Search

CPC ..... F01D 9/023; F01D 25/08; F05D 2240/35; F05D 2260/231; F05D 2300/611; F23R 3/002

See application file for complete search history.

(56) References Cited

U.S. PATENT DOCUMENTS 5,209,645 A * 5/1993 Kojima ..... C23C 4/02 416/224
2008/0276619 A1 11/2008 Chopra et al.
(Continued)

FOREIGN PATENT DOCUMENTS

CN 102679397 A 9/2012
EP 1484427 A2 * 12/2004 ..... C23C 28/3215
EP 2128306 A1 12/2009

OTHER PUBLICATIONS

Serbin et al, Investigations of the Working Process in a Lean-Burn Gas Turbine Combustor With Plasma Assistance, 2011 (Year: 2011).*

(Continued)

*Primary Examiner* — Todd E Manahan
*Assistant Examiner* — Edwin Kang
(74) *Attorney, Agent, or Firm* — Beusse Wolter Sanks & Maire

(57) ABSTRACT

A gas turbine engine having a combustor, turbine and transition duct to channel hot gas from combustor to turbine. The transition duct has an internal surface on which the hot gas impinges causing a varying temperature profile. A thermal barrier coating is located on the internal surface having a first and second thermal barrier coating patch. The first patch having a first thickness located on the internal surface and within a first area subject to a higher temperature than an uncoated part and bounded by a first isotherm of a first temperature. The second patch having a second thickness located on the internal surface and within a second area (Continued)

subject to a higher temperature than the uncoated part and bounded by a second isotherm of a second temperature. The second temperature is higher than the first temperature and the second thickness is thicker than the first thickness.

19 Claims, 8 Drawing Sheets

(56) References Cited

U.S. PATENT DOCUMENTS

| | | | | |
|---|---|---|---|---|
| 2010/0293957 | A1* | 11/2010 | Chen | F01D 9/023 60/752 |
| 2011/0014060 | A1* | 1/2011 | Bolcavage | F01D 5/288 416/241 R |
| 2011/0038710 | A1 | 2/2011 | Kemppainen et al. | |
| 2012/0234012 | A1 | 9/2012 | Brown et al. | |
| 2013/0318991 | A1* | 12/2013 | DiCintio | F23R 3/34 60/774 |
| 2015/0135720 | A1* | 5/2015 | Papple | F01D 5/186 60/759 |

OTHER PUBLICATIONS

CN Office Action dated Sep. 18, 2017, for CN patent application No. 201580034427.6.

International Search Report dated Aug. 5, 2015, for PCT application No. PCT/EP2015/062061.

* cited by examiner

GAS TURBINE ENGINE WITH A TRANSITION DUCT AND CORRESPONDING METHOD OF MANUFACTURING A TRANSITION DUCT

CROSS REFERENCE TO RELATED APPLICATIONS

This application is the US National Stage of International Application No. PCT/EP2015/062061 filed 1 Jun. 2015, and claims the benefit thereof. The International Application claims the benefit of European Application No. EP14173945 filed 25 Jun. 2014. All of the applications are incorporated by reference herein in their entirety.

FIELD OF INVENTION

The present invention relates to a transition duct located between a combustor and a turbine section of a gas turbine. Furthermore the invention relates to a gas turbine comprising at least one transition duct and a method of manufacturing a transition duct.

BACKGROUND OF INVENTION

Gas turbine engines include a compressor, a combustor and a turbine arranged in flow series and generally about a rotational axis. During operation, the compressor supplies compressed air to the combustor and which is mixed with a gaseous or liquid fuel. The air/fuel mixture is then burned and the combustion gas is channelled via a transition duct to the turbine section. The combustion gases force rotation of the turbine which in turn drives the compressor via an interconnecting shaft. For gas turbine engines having a cannular combustor arrangement, which is an annular array of combustor cans each having at least one a burner and a combustion chamber, the transition duct has typically a circular inlet that interfaces with the combustor chamber and an outlet in the form of an annular segment. An annular array of transition duct outlets form an annulus for channelling the combustion gases to the turbine.

The transition duct is manufactured from sheet metal walls or could be cast having relatively large surface areas. These large surfaces incur significant thermal expansions and contractions which cause stresses within the walls. These thermal stresses are increased where there is a significant thermal gradient. In addition, the inherent geometry of the transition duct, which transitions from a circular inlet to an annular segment and the interfaces between the combustor and turbine, creates unique stress regimes when subjected to the hot working gases from the combustor.

The service life of the transition duct is partly determined by the absolute temperature it experiences and the temperature distribution or gradient across the component. To protect the component material from over-heating, conventionally thermal-barrier coatings (TBC) are applied on the hot gas exposed area and often the entire hot side of the part, which in this case is the internal surface of the transition duct. Here the temperature distribution of the combustion gas flow egressing the combustor is not uniform and therefore the application and uniform thickness of TBC is determined by the maximum temperature experienced and the material's thermal capability. The temperature difference across the transition duct's internal surface can be in the region of 700° C. TBC is applied to the entire internal surface of the transition duct because failure of the TBC commonly occurs at the edges or discontinuities of the TBC.

Failure is usually a debonding of the TBC material from the surface of the transition duct or cracking of the TBC. For this reason, conventional application of TBC is made to the entire internal surface of the transition duct which includes an inlet ring and an exit flange that form a complex geometrical shape.

Conventional application of TBC is in a uniform thickness and to the entire internal surface of the transition duct and which is satisfactory in reducing the temperature experienced by the sheet metal wall material. However, there remains a considerable thermal gradient across the transition duct and in-service experience has uncovered thermally-induced debonding and cracking of the TBC because of thermal stresses.

SUMMARY OF INVENTION

To address the problems of known transition ducts described above and for the advantages described below, there is provided a gas turbine engine having a combustor, a turbine and a transition duct, the transition duct is located between the combustor and the turbine to channel hot gas from the combustor to the turbine, the transition duct has an internal surface on which the hot gas impinges to cause a varying temperature profile over the internal surface, a thermal barrier coating is located on the internal surface and comprises at least a first thermal barrier coating patch and a second thermal barrier coating patch, the first thermal barrier coating patch having a first predetermined thickness located on the internal surface and within a first area subject to a higher temperature than an uncoated part of the internal surface and bounded by a first isotherm of a first predetermined temperature, the second thermal barrier coating patch having a second predetermined thickness located on the internal surface and within a second area subject to a higher temperature than the uncoated part of the internal surface and bounded by a second isotherm of a second predetermined temperature, wherein the second predetermined temperature is higher than the first predetermined temperature and the second predetermined thickness is thicker than the first predetermined thickness.

The thickness may be a minimum thickness within the first thermal barrier coating patch and/or the second thermal barrier coating patch, and the minimum thickness is located about the respective first isotherm and/or second isotherm.

The thermal barrier coating may comprise a transition portion, the transition portion has a varying thickness.

The thermal barrier coating comprises a step. The step may be either a sudden increase in thickness or may be a gradual increase in thickness.

The transition duct may have a depression and at least a part of the thermal barrier coating is located within the depression.

The depression may comprise at least a step and at least one of first thermal barrier coating patch or second thermal barrier coating patch is located on the step.

The depression may comprise at least a first step and a second step and the first thermal barrier coating patch is located on the first step and the second thermal barrier coating patch is located on the second step.

The depression may comprise at least a smooth profile and at least one of first thermal barrier coating patch and/or second thermal barrier coating patch is located on the smooth profile.

The depression may comprise at least a first step and a second step and the first thermal barrier coating patch is located on the first step and the second thermal barrier coating patch is located on the second step.

The transition duct forms a gas washed surface defined partly by the internal surface and partly by the thermal barrier coating, and the gas washed surface is smooth and uninterrupted.

In another aspect of the present invention there is provided a method of manufacturing a transition duct for a gas turbine engine, the transition duct has an internal surface on which hot gas impinges to cause a varying temperature profile over the internal surface, the method may comprise determining at least a first isotherm of a first predetermined temperature and a second isotherm of a second predetermined temperature, applying a first thermal barrier coating patch having a first predetermined thickness located on the internal surface and within a first area subject to a higher temperature than an uncoated part of the internal surface and bounded by the first isotherm of a first predetermined temperature, applying a second thermal barrier coating patch having a second predetermined thickness located on the internal surface and within a second area subject to a higher temperature than the uncoated part of the internal surface and bounded by the second isotherm of a second predetermined temperature, wherein the second predetermined temperature is higher than the first predetermined temperature and the second predetermined thickness is thicker than the first predetermined thickness.

The method may comprise forming a depression in the transition duct corresponding to at least one of the first area or second area, applying at least one of the first thermal barrier coating patch or the second thermal barrier coating patch in the depression. The depression can be formed by hydroforming, casting, pressing, machining and etching.

The depression comprises at least a step and at least one of first thermal barrier coating patch or the second thermal barrier coating patch is located on the step.

The depression may comprise at least a first step and a second step and the first thermal barrier coating patch is located on the first step and the second thermal barrier coating patch is located on the second step.

The depression may comprise at least a smooth profile and at least one of first thermal barrier coating patch and/or second thermal barrier coating patch is located on the smooth profile.

The following are advantages of the present invention:

a. Improved temperature gradient across the component and thus reduced creep deformation of the transition duct.

b. Extended life of the of the transition duct, by virtue of reduced thermal stresses and otherwise thermal fatigue.

c. Reduced cost of TBC application, by virtue of less TBC coverage.

d. Simplification of TBC application process, by virtue of applying TBC in areas that are more accessible and cover less complex geometry.

e. Reduced maintenance requirements of the engine in terms of inspections and replacement of transitions ducts.

f. Reduced engine downtime particularly in the event of a failure of a transition duct.

g. Increased engine availability to the customer for their power requirements.

BRIEF DESCRIPTION OF THE DRAWINGS

The above mentioned attributes and other features and advantages of this invention and the manner of attaining them will become more apparent and the invention itself will be better understood by reference to the following description of embodiments of the invention taken in conjunction with the accompanying drawings, wherein.

DETAILED DESCRIPTION OF INVENTION

Figure 1:
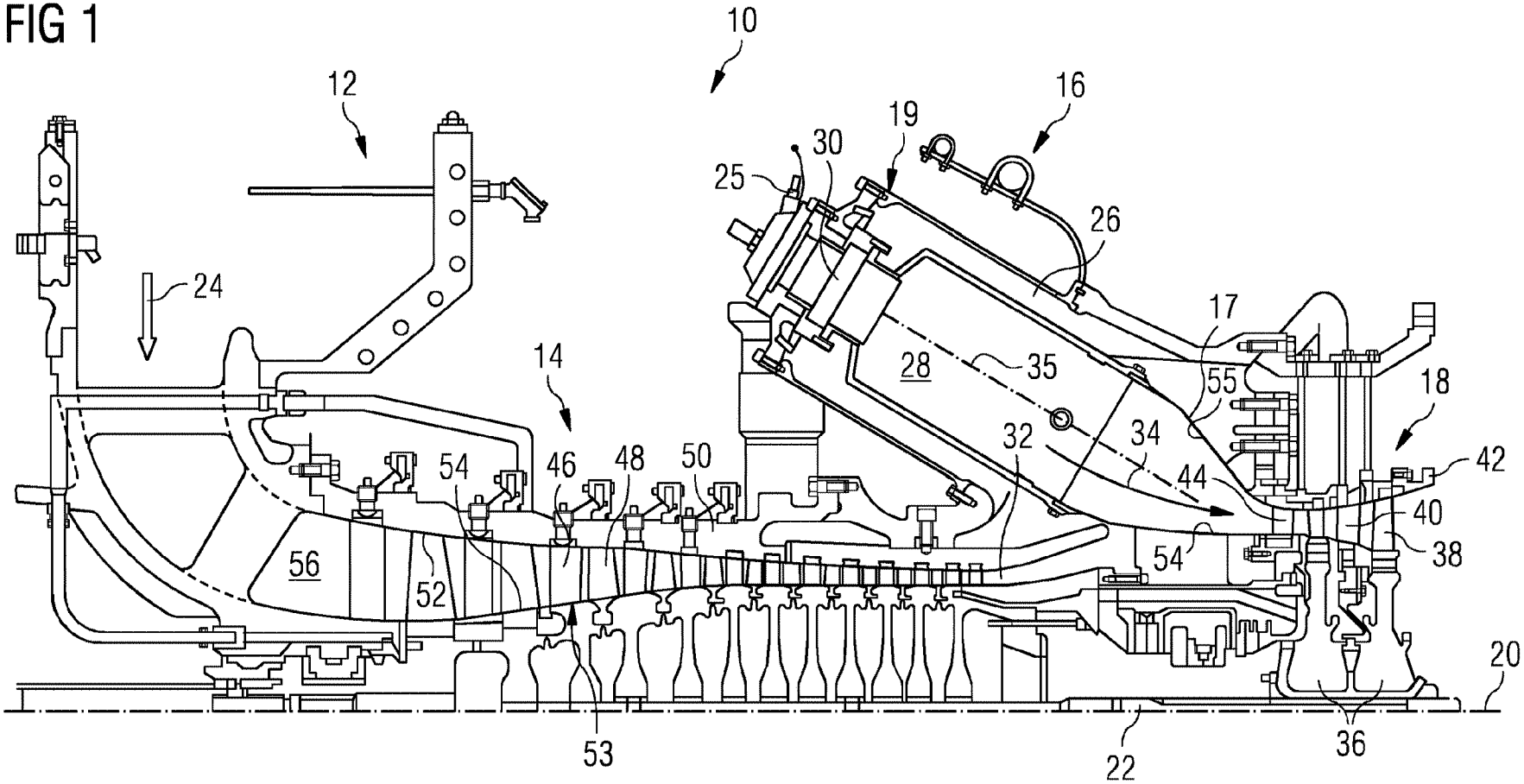
FIG. 1 shows part of a turbine engine in a sectional view and in which the present inventive transition duct is incorporated.

FIG. 1 shows an example of a gas turbine engine 10 in a sectional view. The gas turbine engine 10 comprises, in flow series, an inlet 12, a compressor section 14, a combustor section 16 and a turbine section 18 which are generally arranged in flow series and generally about and in the direction of a longitudinal or rotational axis 20. The gas turbine engine 10 further comprises a shaft 22 which is rotatable about the rotational axis 20 and which extends longitudinally through the gas turbine engine 10. The shaft 22 drivingly connects the turbine section 18 to the compressor section 14.

In operation of the gas turbine engine 10, air 24, which is taken in through the air inlet 12 is compressed by the compressor section 14 and delivered to the combustion section or burner section 16. The burner section 16 comprises a burner plenum 26, one or more combustion chambers 28 and at least one burner 30 fixed to each combustion chamber 28. The combustion chambers 28 and the burners 30 are located inside the burner plenum 26. The compressed air passing through the compressor 14 enters a diffuser 32 and is discharged from the diffuser 32 into the burner plenum 26 from where a portion of the air enters the burner 30 and is mixed with a gaseous or liquid fuel. The air/fuel mixture is then burned and the combustion gas 34 or working gas from the combustion is channelled through the combustion chamber 28 to the turbine section 18 via a transition duct 17.

This exemplary gas turbine engine 10 has a cannular combustor section arrangement 16, which is constituted by an annular array of combustor cans 19 each having the burner 30 and the combustion chamber 28, the transition duct 17 has a generally circular inlet that interfaces with the combustor chamber 28 and an outlet in the form of an annular segment. An annular array of transition duct outlets form an annulus for channelling the combustion gases to the turbine 18.

The turbine section 18 comprises a number of blade carrying discs 36 attached to the shaft 22. In the present example, two discs 36 each carry an annular array of turbine blades 38. However, the number of blade carrying discs could be different, i.e. only one disc or more than two discs. In addition, guiding vanes 40, which are fixed to a stator 42 of the gas turbine engine 10, are disposed between the stages of annular arrays of turbine blades 38. Between the exit of the combustion chamber 28 and the leading turbine blades 38 inlet guiding vanes 44 are provided and turn the flow of working gas onto the turbine blades 38.

The combustion gas from the combustion chamber 28 enters the turbine section 18 and drives the turbine blades 38 which in turn rotate the shaft 22. The guiding vanes 40, 44 serve to optimise the angle of the combustion or working gas on the turbine blades 38.

The turbine section 18 drives the compressor section 14. The compressor section 14 comprises an axial series of vane stages 46 and rotor blade stages 48. The rotor blade stages 48 comprise a rotor disc supporting an annular array of blades. The compressor section 14 also comprises a casing 50 that surrounds the rotor stages and supports the vane stages 48. The guide vane stages include an annular array of radially extending vanes that are mounted to the casing 50. The vanes are provided to present gas flow at an optimal angle for the blades at a given engine operational point. Some of the guide vane stages have variable vanes, where the angle of the vanes, about their own longitudinal axis, can be adjusted for angle according to air flow characteristics that can occur at different engine operations conditions.

The casing 50 defines a radially outer surface 52 of the passage 56 of the compressor 14. A radially inner surface 54 of the passage 56 is at least partly defined by a rotor drum 53 of the rotor which is partly defined by the annular array of blades 48.

The present invention is described with reference to the above exemplary turbine engine having a single shaft or spool connecting a single, multi-stage compressor and a single, one or more stage turbine. However, it should be appreciated that the present invention is equally applicable to two or three shaft engines and which can be used for industrial, aero or marine applications.

The terms upstream and downstream refer to the flow direction of the airflow and/or working gas flow through the engine unless otherwise stated. The terms forward and rearward refer to the general flow of gas through the engine. The terms axial, radial and circumferential are made with reference to the rotational axis 20 of the engine.

Figure 2:
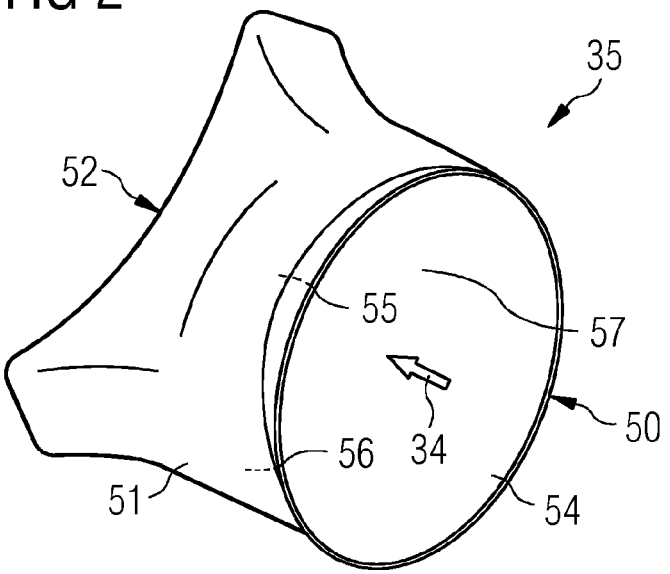
FIG. 2 is a perspective view looking in a generally downstream direction, with respect to the flow of combustion gases, of a transition duct of the turbine engine and in accordance with the present invention.
Figure 3:
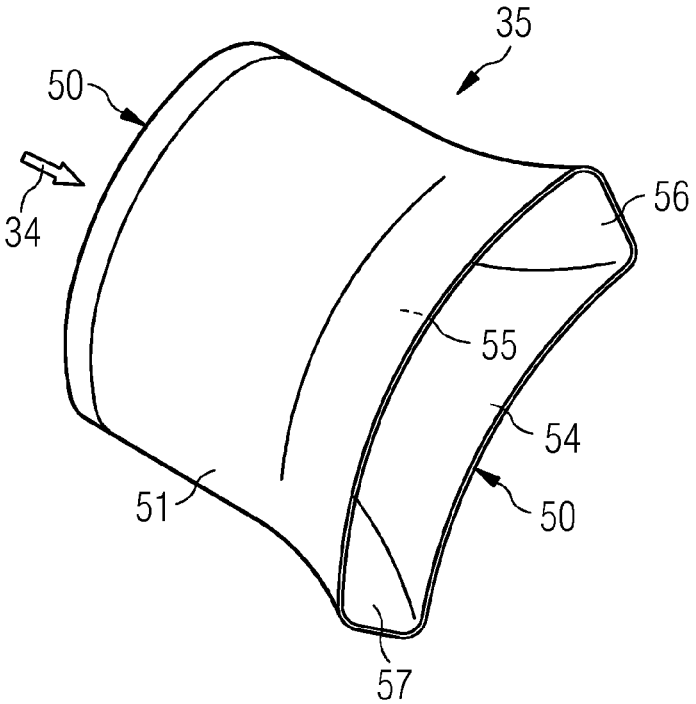
FIG. 3 is a perspective view looking in a generally upstream direction, with respect to the flow of combustion gases, of a transition duct of the turbine engine and in accordance with the present invention.

Referring to FIGS. 2 and 3 which show two perspective views on the inlet and outlet respectively of a transition duct 17 and in accordance with the present invention. The transition duct 17 has a generally circular inlet 50 that interfaces and connects to the downstream end of the combustor can 27 and an outlet 52 in the form of an annular segment that connects to the turbine 18. An annular array of transition ducts forms an annulus for channelling the combustion gasses to the turbine. The transition duct 17 has internal surfaces 54, 55, 56, 57 that are radially inner, radially outer and opposing lateral internal surfaces respectively. Referring back to FIG. 1, the radially inner internal surface 54 and the radially outer internal surface 55 are also referenced for clarity.

The transition duct 17 is manufactured from sheet metal, which define the wall or walls, generally denoted 51, and having relatively large surface areas, in particular internal surfaces 54 and 55. These large surfaces incur significant thermal expansions and contractions which cause internal stresses in the sheet metal. These thermal stresses are increased where there is a significant thermal gradient over the surfaces and throughout the walls 51 of the transition duct. In addition, the inherent geometry of the transition duct, which transitions from a generally circular inlet 50 to an annular segment outlet 52 and the interfaces between the combustor and turbine, creates unique stress regimes when subjected to the hot working gases from the combustor. In some gas turbines and dependent on the thermal loading, the transition duct 17 may comprise one wall of sheet metal, as shown here, and an outer wall. Cooling air is often supplied between the two wall of sheet metal to cool the components via convection and conduction from its surfaces. The present invention is equally applicable to these double walled transition ducts.

Figure 4:
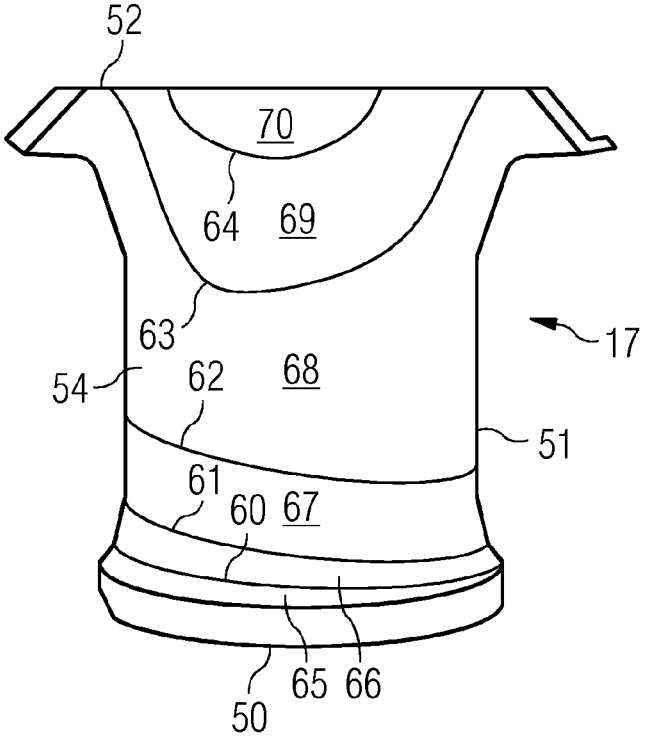
FIG. 4 is a view on an internal surface of the transition duct showing thermal isotherms of the temperature experienced by the surface.

FIG. 4 is a view on the radially inner internal surface 54 and depicts an approximate thermal contour plot of the temperature of the surface of a transition duct 17 during operation of the turbine engine 10. The contour plot includes a series of isotherms 60-64 that each connect points of equal temperature and demarcate areas 65-70 of the surface that indicate a range of temperatures between the isotherms. Generally, the isotherms 60-64 increase in temperature from the inlet 50 to the outlet 52. Therefore, the surface temperature experienced by the areas 65-70 increases from area 65 to area 70.

The temperature distribution of the combustion gas flow 34 egressing the combustor 16 is not uniform and which therefore incurs a significant temperature difference or gradient across the transition duct 17 which can be in the region of 700° C. Furthermore and as can be seen in FIG. 1 a centre-line 35 of the combustor 16 is incident on the radially inner internal surface 54. Therefore the combustion gases 34 have a tendency to impinge on a particular area of the internal surface 54 and in this example surface areas 69 and 70 incur particularly high temperatures and therefore temperature gradients causing high thermally induces stresses and strains within the transition duct wall 51 material. This impingement of the combustor gases further exacerbates the temperature gradient throughout the transition duct 17.

For the absence of doubt it is one object of the present invention to reduce the temperature of the surface of the wall of the transition duct and therefore the bulk temperature of the wall itself. The presence of a thermal barrier coating reduces the temperature of the surface of the transition duct wall under and by virtue of the thermal barrier coating and therefore the temperature of the wall is correspondingly reduced. Where applied, the outer surface of the thermal barrier coating still experiences the same or nearly the same hot gases temperatures as an uncoated wall surface.

Figure 5:
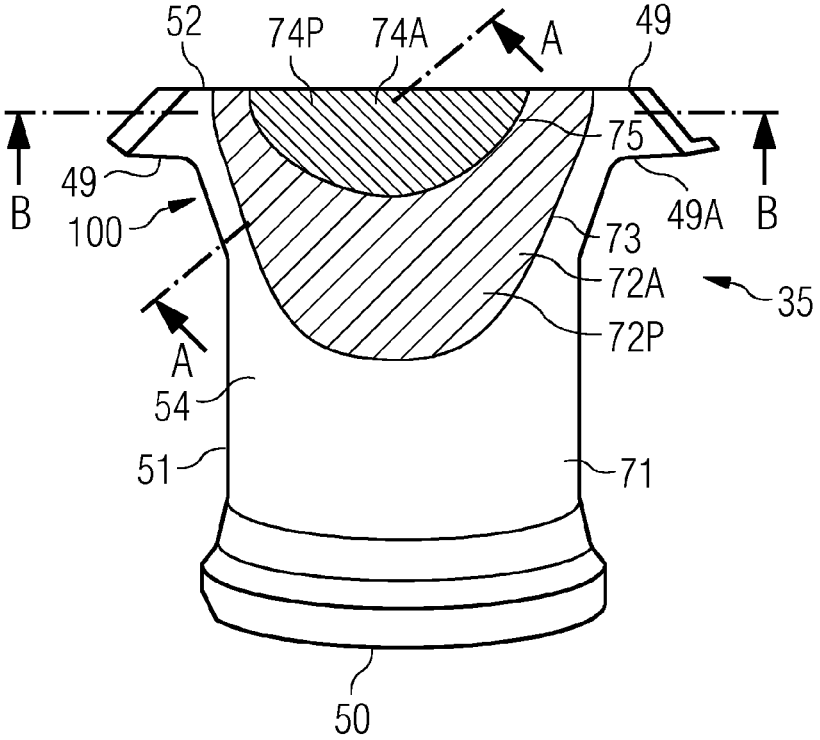
FIG. 5 is a view on an internal surface of the transition duct showing patches of thermal barrier coatings having different or varying thicknesses.

FIG. 5 is a similar view to FIG. 4 of the radially inner internal surface 54. A thermal barrier coating generally shown as 100 having a first thickness is applied to a first patch 72P which is bounded by line 73. The line 73 is a boundary of the first patch 72P and denotes a first predetermined isotherm value. The line 73 is smoothed between isotherm points so that the TBC patch has a smooth edge or boundary. The metal or wall temperature within the first area 72A is limited or reduced by virtue of the TBC. The thermal barrier coating 100 has a second thickness and is applied to a second patch 74P which is bounded by line 75. The line 75 is a boundary of the second patch 74P and denotes a second predetermined isotherm value. The line 75 is smoothed between isotherm points so that the TBC patch has a smooth edge or boundary. The metal or wall temperature within the second area 70 is limited by virtue of the TBC having a second thickness. The thickness of or within the second TBC patch 74P is greater than the thickness of the first TBC patch 72P. By virtue of the greater thickness of the second TBC patch 74P greater thermal protection is afforded the underlying wall 51 or internal surface temperature. In this way the temperatures experienced by the underlying wall surface 54 in the areas 69 and 70 are reduced or similar to those in the neighbouring uncoated area or areas. Thus the temperature gradient is reduced across the surface 54. The absolute temperatures of the wall's 51 internal surface 54 within the areas 70 and 69 underlying the TBC patches 74P and 72P are reduced and are approximately similar. Thus in reducing the temperature gradient, stresses and strains in the walls 51 of the transition duct are also reduced.

The temperature value of the predetermined isotherm boundary lines 73, 75 of the TBC patches 72 and 74 are determined by a number of factors including the temperature profile across the surface, the properties of the TBC to protect the underlying surface 54, the temperature capability and thermal expansion characteristics of the transition duct wall material and the mechanical stress-strain characteristics of the transition duct during engine operation.

Figure 6:
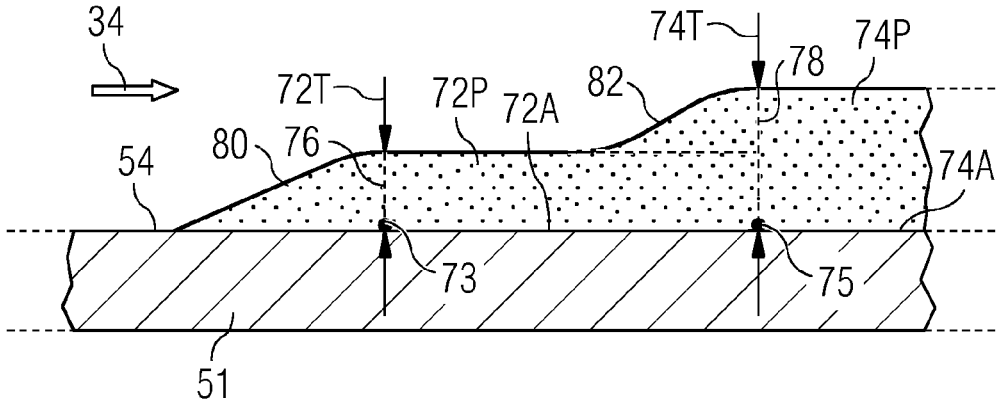
FIG. 6 is a schematic of section A-A shown in FIG. 5 showing a first arrangement of varying thicknesses of thermal barrier coating.

FIG. 6 is a schematic of section A-A shown in FIG. 5 showing a first arrangement of varying thickness 72P, 74P of thermal barrier coating 100. The thermal barrier coating 100 overlies part of the internal surface 54 of the wall 51. The internal surface 54 has a nominal surface profile, for example where this thermal barrier coating 100 is applied as a retrofit or refurbishment. The thermal barrier coating 100 having a first thickness 72T is applied to the first patch 72P which is bounded by the first predetermined isotherm line 73. Thermal barrier coating 100 having a second thickness 74T is applied to the second patch 74P which is bounded by line 75. The line 75 is a boundary of the second patch 74P and denotes a second predetermined isotherm value. The second predetermined isotherm value is greater than the first predetermined isotherm line 73.

As can be seen the thickness of the thermal barrier coating 100 varies between first thickness 72T and second thickness 74T. In one variant of the first arrangement the first thermal barrier coating patch 72P may have a stepped thickness at or about the isotherm line 73 and as shown by the dashed line 76. Similarly the second thermal barrier coating patch 74P may have a stepped thickness increase at or about the isotherm line 75 and as shown by the dashed line 78. However, in a second variant the thickness of the thermal barrier coating is achieved over a transition portion 80 which varies between the internal surface 54 and the first thickness 72T, which is at or about the first isotherm line 73. Similarly, a transition portion 82 varies in thickness between the first thickness 72T and the second thickness 74T, which is at or about the second isotherm line 75.

In either variants of the first arrangement of thermal barrier coating 100, the thickness could be said to be stepped and that such stepping is varying the thickness of the thermal barrier coating 100 from the first to the second thicknesses. The transition portions 80, 82 can further gradually limit the temperature experienced by the underlying surface 51 by virtue of its gradual thickening. It should be noted that the transition portions 80, 82 are provided in front or on the cooler side of the first and second isotherm lines 73, 75. Note that the first and second isotherm lines 73, 75 are predetermined temperature boundaries at which the desired first and second thicknesses 72T, 74T are achieved. The first and second isotherm lines 73, 75 can be predetermined based on thermal paint tests or thermal imaging of the surface of the transition duct in use. The operational point of the engine at which the predetermined first and second isotherm lines 73, 75 can be where the greatest thermal gradient is experienced and which can be during the maximum engine output, but could also be at a lower engine output.

Figure 7:
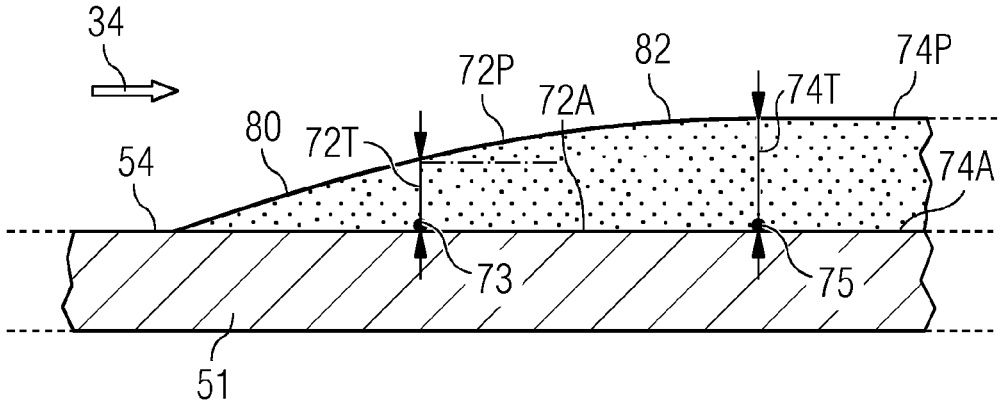
FIG. 7 is a schematic of section A-A shown in FIG. 5 showing a second arrangement of varying thicknesses of thermal barrier coating.

FIG. 7 is a schematic of section A-A shown in FIG. 5 showing a second arrangement of varying thickness of thermal barrier coating 100. The same reference numerals have been used to denote the same elements in FIG. 7 as FIG. 6. The thickness of the thermal barrier coating 100 is indicated as first and second thicknesses 72T, 74T and which each thickness occurs at or about first and second predetermined isotherm lines 73, 75 respectively. In this second arrangement of varying thickness of thermal barrier coating 100 the portion between first and second thicknesses 72T, 74T is gradually increased from isotherm line 73 to isotherm line 75. The same transition portion 82 is applied to the internal surface 54 up to the first isotherm line 73 to smoothly blend between the surface 54 and the required thickness of thermal barrier coating 73T at isotherm 73. The intention is to vary or graduate the thickness of thermal barrier coating 100 to gradually increase thermal protection to the wall 51 where associated with a gradual increase in temperature profile experienced by and over the surface from the combustion gases. Thus by gradually increasing the thickness of thermal barrier coating 100, the wall can be kept at a more constant temperature thereby reducing or minimising thermal stresses.

Figure 8:
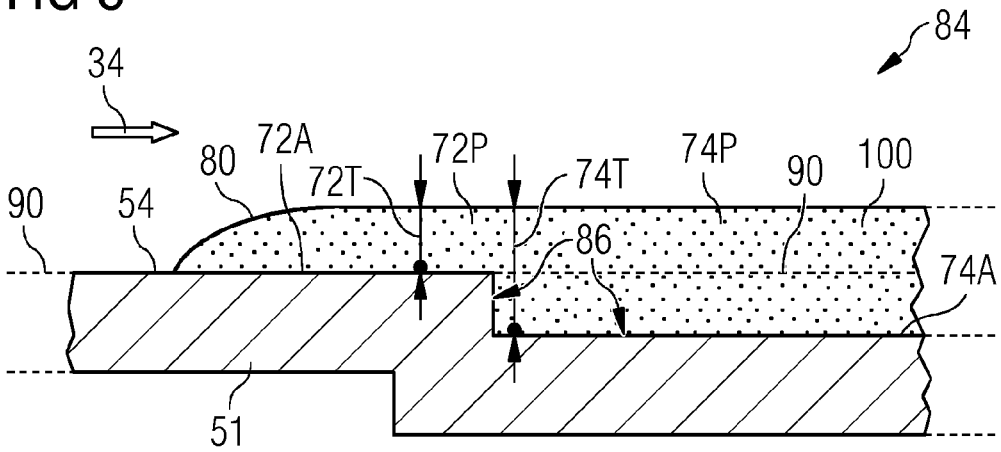
FIG. 8 is a schematic of section A-A shown in FIG. 5 showing a third arrangement of varying thicknesses of thermal barrier coating.

FIG. 8 is a schematic of section A-A shown in FIG. 5 showing a third arrangement of varying thickness of thermal barrier coating. The same reference numerals have been used to denote the same elements in FIG. 8 as in FIG. 6. For this third arrangement, the wall 51 is formed with a depression 84 relative to a nominal profile 90 and into which the thermal barrier coating 100 is at least partly located. The depression 84 comprises at least a first step 86. The thermal barrier coating 100 overlies a portion of the internal surface 54 to the first thickness 72T at the first predetermined isotherm line 73 as a first patch 72P over a first area 72A. The thermal barrier coating 100 further overlies the first step 86 which forms the second area 74A and to a second thickness 74T as a second patch 74P. The first step 86 is located at or about the second predetermined isotherm line 75.

The depression 84 minimises the thickness of thermal barrier coating 100 above the nominal profile and reduces any aerodynamic disturbance of the combustions gases 34 and subsequent performance loss.

Figure 9:
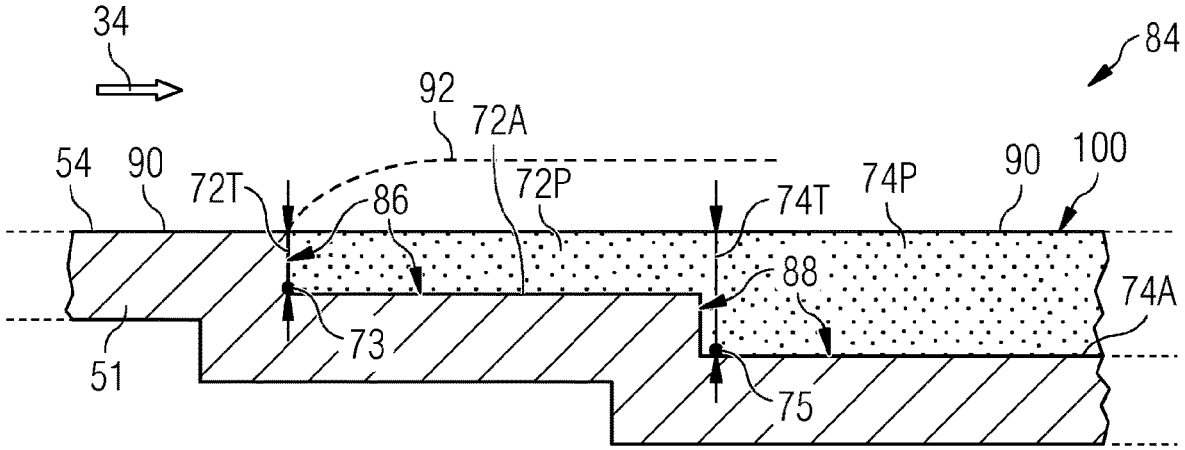
FIG. 9 is a schematic of section A-A shown in FIG. 5 showing a fourth arrangement of varying thicknesses of thermal barrier coating.

FIG. 9 is a schematic of section A-A shown in FIG. 5 showing a fourth arrangement of varying thickness of thermal barrier coating 100. The same reference numerals have been used to denote the same elements in FIG. 9 as in FIGS. 6, 7 and 8 where appropriate. For this fourth arrangement, the wall 51 is formed with the depression 84, relative to a nominal profile 90, and into which the thermal barrier coating 100 is at least partly located. The depression 84 comprises at least a first step 86 and a second step 88. The thermal barrier coating 100 overlies the first step 86 that forms the first area 72A and to a first thickness 72T as a first patch 72P. The first step 86 is located at or about the first predetermined isotherm line 75. The thermal barrier coating 100 further overlies the second step 88 which forms the second area 74A and to a second thickness 74T as a second patch 74P. The first step 86 is located at or about the second predetermined isotherm line 75.

An additional thermal barrier coating 92 thickness, which in this case is at least partly gradually thickening, may be applied over the first and second thickness 72T, 74T to increase the overall thickness of the thermal barrier coating 100. This additional thermal barrier coating 92 thickness lies above the nominal profile 90. This additional thermal barrier coating 92 thickness may be implemented where the depth of the depression 84 is limited for example by mechanical integrity or space restrictions.

Figure 10:
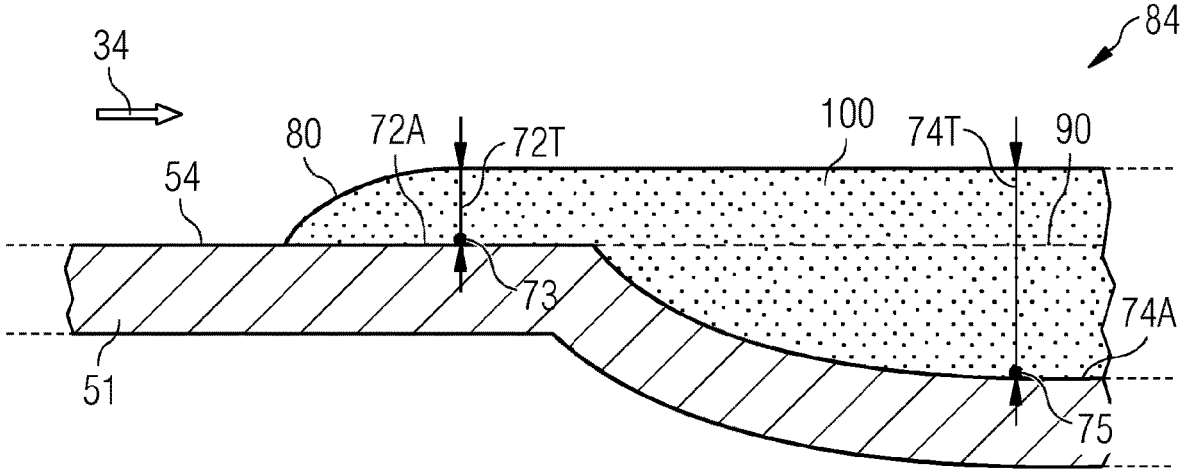
FIG. 10 is a schematic of section A-A shown in FIG. 5 showing a fifth arrangement of varying thicknesses of thermal barrier coating.

FIG. 10 is a schematic of section A-A shown in FIG. 5 and showing a fifth arrangement of varying thickness of thermal barrier coating 100. The same reference numerals have been used to denote the same elements in FIG. 10 as in FIG. 6-9 where appropriate. For this fifth arrangement, the wall 51 is again formed with the depression 84; however, the depression 84 now has a smooth profile 98 rather than the stepped profile shown and described with reference to FIGS. 8 and 9. The depression 84 has an initial depth of zero where its profile 98 meets the nominal profile 90 and gradually deepens to the second predetermined depth at the second predetermined isotherm line 75. The thermal barrier coating 100 is applied on the first area 72A, which is part of the nominal profile surface 90, to form the first patch 72P to the first predetermined thickness 72T. The thermal barrier coating 100 is applied on the second area 72A, which is part of the depression's 84 surface, to form the second patch 74P to the second predetermined thickness 74T.

Figure 11:
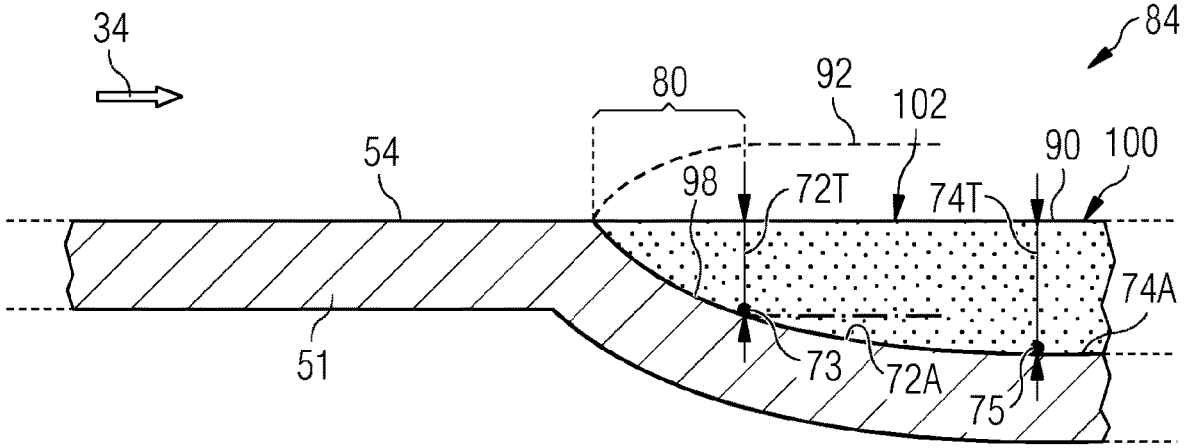
FIG. 11 is a schematic of section A-A shown in FIG. 5 showing a sixth arrangement of varying thicknesses of thermal barrier coating.

FIG. 11 is a schematic of section A-A shown in FIG. 5 showing a sixth arrangement of varying thickness of thermal barrier coating 100. The same reference numerals have been used to denote the same elements in FIG. 11 as in FIG. 6-10 where appropriate. For this fifth arrangement, the wall 51 is again formed with the depression 84; however, the depression 84 now has a smooth profile 98 rather than the stepped profile shown and described with reference to FIGS. 8 and 9. The depression 84 has an initial depth of zero where its profile 98 meets the nominal profile 90 and gradually deepens to the first predetermined depth at the first predetermined isotherm line 73. The depression 84 may then gradually deepen to a second predetermined depth at the second predetermined isotherm line 75. The first and second predetermined depths may correspond to the first and second predetermined thickness 72T, 74T of the thermal barrier coating. Alternatively, where the additional thermal barrier coating 92 thickness lies above the nominal profile 90 the depth of the depression may be reduced to achieve the require thermal protection for the transition duct walls 51.

This sixth arrangement of varying thickness of thermal barrier coating 100 lends itself to the formation of the transition portion 80 located between where the profile 98 meets the nominal profile 90 and the first predetermined isotherm line 73.

The third and sixth arrangements can each form a smooth and uninterrupted gas wash surface 102 for the internal surface of the transition duct. Thus as the combustion gas 34 flows from the uncoated part of the surface 54 to the coated portions 72P and 74P or vice versa, there are no irregularities, steps or recesses that can disturb the combustor gas flow.

In addition, even where the thermal barrier coating 100 is formed overlying the nominal profile 90, the thermal barrier coating 100 still presents a smooth gas wash surface which minimises aerodynamic losses and minimises turbulence in the combustion gas flow 34 passing thereover.

A further advantage of the present invention is that the extent of coverage of the internal surface of the transition duct by the thermal barrier coating 100 is significantly reduced saving materials, time and cost of manufacturing. Furthermore, reliability is also improved because the areas being covered by the thermal barrier coating 100 have relatively simple surface profiles or are protected by virtue of the depression rather than previous thermal barrier coating schemes which cover complex geometry such as highly curved walls and difficult to reach areas. The highly curved walls and difficult to reach surface areas are particularly found about transition arms 49 as shown in FIG. 5. The internal surface of the transition arm 49 has a tightly radius surface curve 49A. These highly curved walls and difficult to reach areas can be prone to both high thermal stresses and strains as well as manufacturing difficulties including achieving a good bond to the underlying surface, uniform thickness and accessibility.

The transition portion 80, 82 may be located at any position around the thermal barrier coating 100 such as an upstream, a downstream and the lateral positions with respect to the general flow of combustion gases 34. Similarly, the steps 86, 88 and gradual thickening portions (92) may be located at any position around the thermal barrier coating 100 such as an upstream, a downstream and the lateral positions with respect to the general flow of combustion gases 34.

Figure 12:
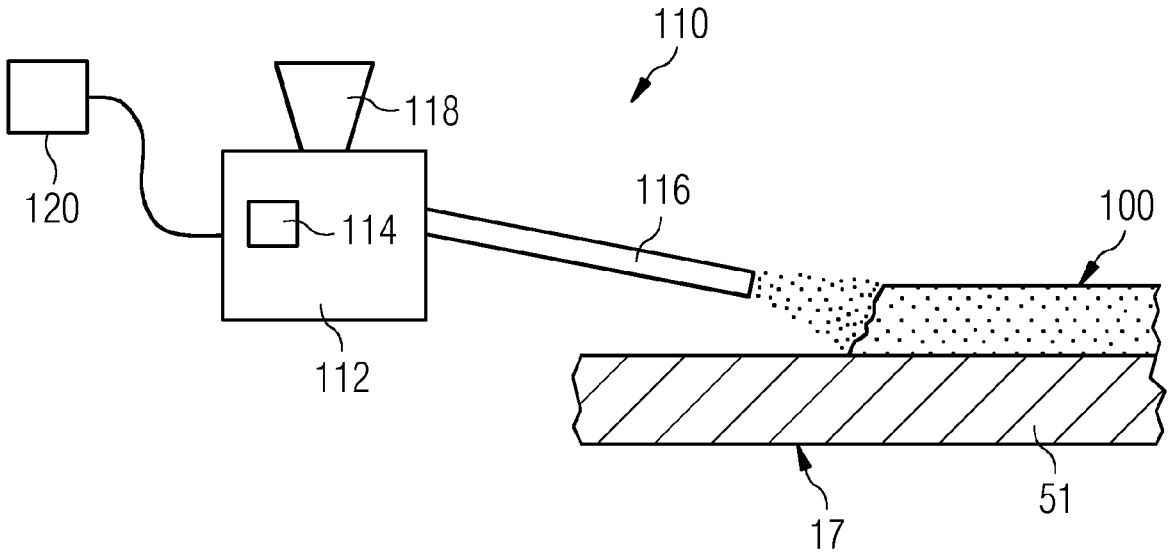
FIG. 12 is a schematic illustration of equipment for depositing the thermal barrier coating on the transition duct.

The equipment and environment used for application of thermal barrier coatings are very well known and will not be described in detail here except that any one of the following known methods can be used Electron Beam Physical Vapor Deposition (EBPVD), Air Plasma Spray (APS), High Velocity Oxygen Fuel (HVOF), Electrostatic Spray Assisted Vapour Deposition (ESAVD) and Direct Vapor Deposition (DVD). Nonetheless, referring to FIG. 12, a thermal barrier coating application device 110 comprises a housing 112, having a power supply means 114 and a delivery nozzle 116, and a material hopper 118. An electronic controller 120 controls aspects of the thermal barrier coating application device 110 such as position of the delivery nozzle 116, rate of supply of the thermal barrier coating material and speed of the delivery nozzle 116 across the surface 54, 55, 56, 57.

The electronic controller 120 holds a model of the geometry of the transition duct 17 and is programmable to the extent that the delivery nozzle 116 is moveable over the surfaces of the transition duct 17 to deposit thermal barrier coating material in any desired location.

The first isotherm 73 of a first predetermined temperature and a second isotherm 75 of a second predetermined temperature are determined based on any one of a number of methods including thermal paint testing or computer modelling of the temperature profile of the transition duct or by thermal imaging of the transition duct in use. It should be noted that more than two isotherms may be determined for this or other applications of the present invention. The location of first and second isotherms 73, 75, which define the first and second areas 72A, 74A, is dependent on any one or more of the factors including temperature, temperature gradient, stress/strain regime within the component and material properties such as thermal expansion coefficient, strength and fatigue characteristics. In addition, consideration of the thermal protection afforded by the thermal barrier coating 100 is taken into account in deciding the location of the first and second isotherms 73, 75 and any further isotherms. Also for consideration is the thickness of the thermal barrier coating 100 and in particular the temperature difference across the thickness of the thermal barrier coating. Thus not only is the location of the isotherms 73, 75 selected by virtue of the parameters mentioned above, but also in conjunction with the thickness of the thermal barrier coating patches 72T and 74T.

Once the isotherms 73, 75 and the thicknesses of the at least two thickness of thermal barrier coating patches 72T, 74T have been selected to minimise the temperature gradient across an internal surface of the transition duct 17, the first and second isotherm values are inputted to the controller 112 and a programme within the controller 112 then formulates the coordinates of the isotherm lines 73, 75. The required thicknesses of the first and second thermal barrier coating patches 72T and 74T are also inputted to the controller 112. Thus the controller 112 formulates a path for the delivery nozzle to follow and deposit thermal barrier material to form the thermal barrier coating 100. The controller 112 also formulates the required speed of the delivery nozzle 116, the rate of deposition of material and number of passes to form the required thickness at any location within the thermal barrier coating 100. The controller is also programmable to formulate necessary deposits to form the transition portions 80, 82.

Figure 13:
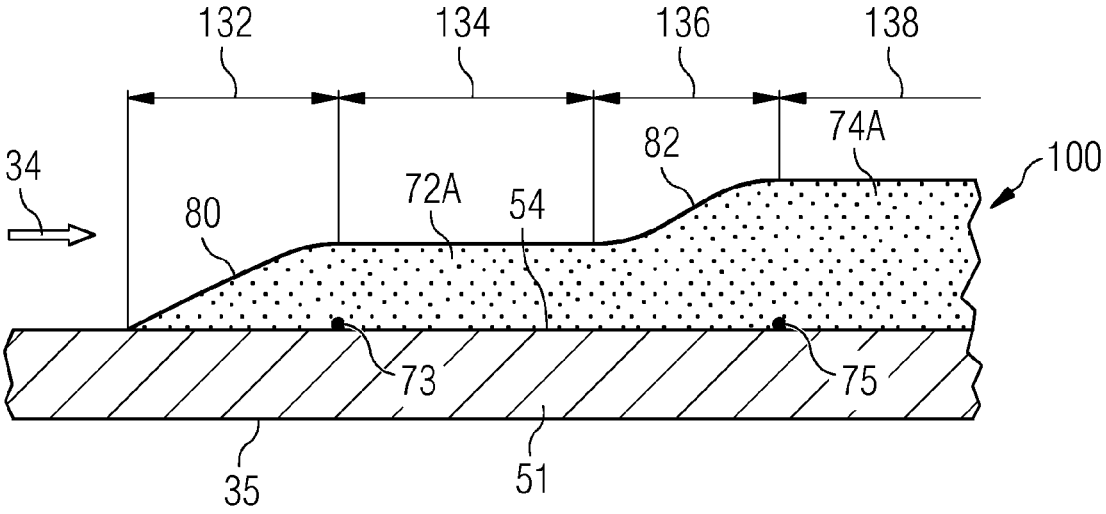
FIG. 13 is a schematic of section A-A shown in FIG. 5, which showing the first arrangement of varying thicknesses of thermal barrier coating similar to FIG. 6 and illustrating deposition zones for the thermal barrier coating.

FIG. 13 is a schematic section A-A showing the transition duct wall 51 and the first arrangement of varying thicknesses of thermal barrier coating 100. This first arrangement is an exemplary embodiment and the method for forming the thermal barrier coating may be equally applied to all the embodiments described herein. In the direction of arrow 34, the thermal barrier coating 100 can be divided into a number of zones. Zone 132 is the transition portion 80, zone 134 is the constant thickness TBC patch 72P, zone 136 is the transition portion 82 and zone 138 is the constant thickness TBC patch 74P.

In the direction of arrow 130, for zone 132, increased deposition thickness of the thermal barrier coating can be made by any one or combination of reducing the speed of the nozzle 116 and increasing the rate of feed of TBC material from the hopper 118 to the nozzle 116 to increase the amount of TBC material landing on the surface 51. Over the TBC patch 72A and in zone 134, where there is a constant thickness of TBC, the nozzle speed and rate of feed of TBC material can be held constant, although either can be increased or decreased respectively to maintain a desired deposition rate and thickness.

Depending on the required thickness of the first and second thicknesses 72T, 74T of the TBC 100, the second TBC patch 74P can be formed in two ways. Firstly, in the direction of arrow 130, for zone 136, the increased deposition thickness of the transition portion 82 can be made by any one or combination of reducing the speed of the nozzle 116 and increasing the rate of feed of TBC material from the hopper 118 to the nozzle 116 to increase the amount of TBC material landing on the surface 51. Over the TBC patch 74A and in zone 138, where there is a constant thickness of TBC, the nozzle speed and rate of feed of TBC material can be held constant, although either can be increased or decreased respectively to maintain a desired deposition rate and thickness. In this case reducing the speed of the nozzle 116 and increasing the rate of feed of TBC material from the hopper 118 to the nozzle 116 will be in addition to the respective rate compared to those of the zone 134. Secondly, the first patch 72P of TBC can be extended and cover the second area 74A. In this case the zones 136 and 138 can be formed by two or more layers over the extended first patch 72P in the same way as zones 132 and 134 and will not be repeated again.

Figure 14:
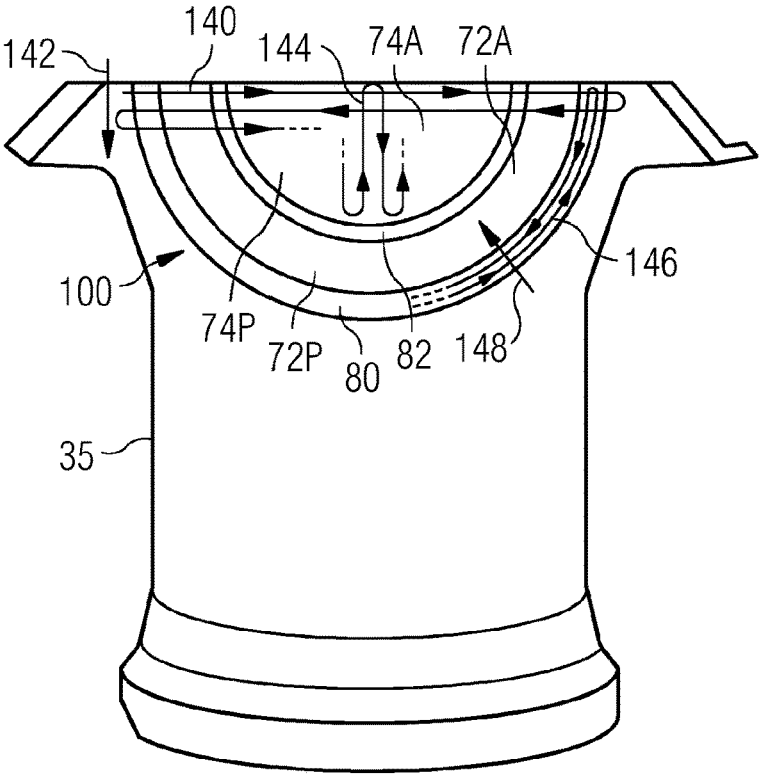
FIG. 14 is a view on the internal surface of the transition duct showing patches of thermal barrier coatings having different or varying thicknesses and a number of paths of a delivery nozzle suitable to form the thermal barrier coating.

FIG. 14 is a view on the internal surface of the transition duct showing patches 72P, 74P of thermal barrier coatings applied to areas 72A, 74A and having different or varying thicknesses 72T, 74T. A number of paths of the delivery nozzle 116 can be programmed to form the thermal barrier coating 100.

In one embodiment, the variable thermal barrier coating 100 is formed by a first path 140 which extends across the entire thermal barrier coating patch. The TBC is deposited in rows with each row forming adjacent the next in the direction of arrow 142. As the deposition nozzle 116 traverses the internal surface 54 the varying thicknesses of the thermal barrier coating is achieved by any one or combination of altering the speed of the nozzle 116 and altering the rate of feed of TBC material from the hopper 118 to the nozzle 116 to increase or decrease the amount of TBC material landing on the surface 51 as described above.

In another embodiment, where the thermal barrier coating is too thick to deposit in one layer e.g. the second TBC patch 74P, the delivery nozzle 116 retraces the relevant part of the first path 140 to form a second (or more) layer and thus the thicker TBC patch 74P. Alternatively, where the first patch 72P of TBC is extended and covers the second area 74A, a second path 144 of the delivery nozzle 116 traverses the second thickness patch 74T. This path 144 is shown creating rows of TBC deposit in a transverse manner to the first path 140. However, the second path can be in any orientation relative to the first path 140.

In another embodiment, the transition portions 80, 82 or where the thermal barrier coating 100 gradually changes thickness, the delivery nozzle 116 is directed along a third path 146. As the rows of thermal barrier coating are deposited, generally in the direction of arrow 148, the delivery nozzle speed is decreased and/or the rate of feed of TBC material from the hopper 118 to the nozzle 116 is increased.

Figure 15:
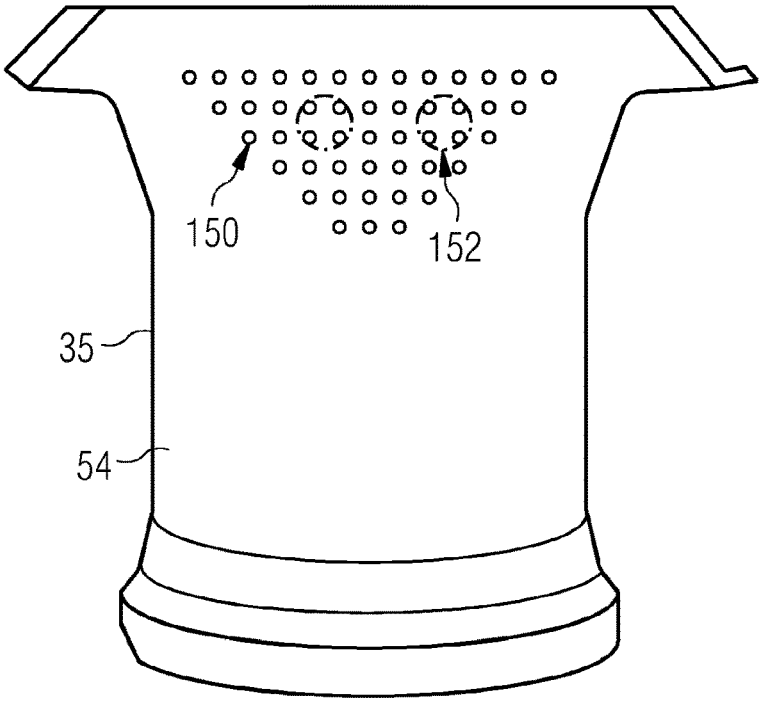
FIG. 15 is a view on an internal surface of the transition duct showing an array of effusion cooling holes and in dashed lines a number of dilution holes.

FIG. 15 is a view on the internal surface 54 of the transition duct 17 showing an array of effusion cooling holes 150 and in dashed lines a number of dilution holes 152. In addition to any of the varying thickness thermal barrier coating arrangements described herein, effusion cooling holes 150 may be provided to provide a film of cooling fluid over a part of the surface 54. The effusion cooling holes 150 penetrate through the wall 51 of the transition duct 17 and through any thermal barrier coating 100. The application of the variable thickness thermal barrier coating 100 may reduce the number and/or extent of the effusion cooling holes 150. Consideration of the cooling effect of the effusion cooling holes 150, where present, is taken into account when devising extent, location and thickness of the thermal barrier coating 100 and its varying thicknesses. Essentially, for a transition duct 17 with effusion cooling holes 150 the isotherm lines 73, 75 and the method of determining the isotherm lines, remain related to the actual temperature of the surface 54 of the wall 51. Similarly, where the transition duct 17 includes dilution holes 152 the local temperature of the surface of the wall can be affected and again the isotherm lines 73, 75 and the method of determining the isotherm lines, remain related to the actual temperature of the surface 54 of the wall 51.

Figure 16:
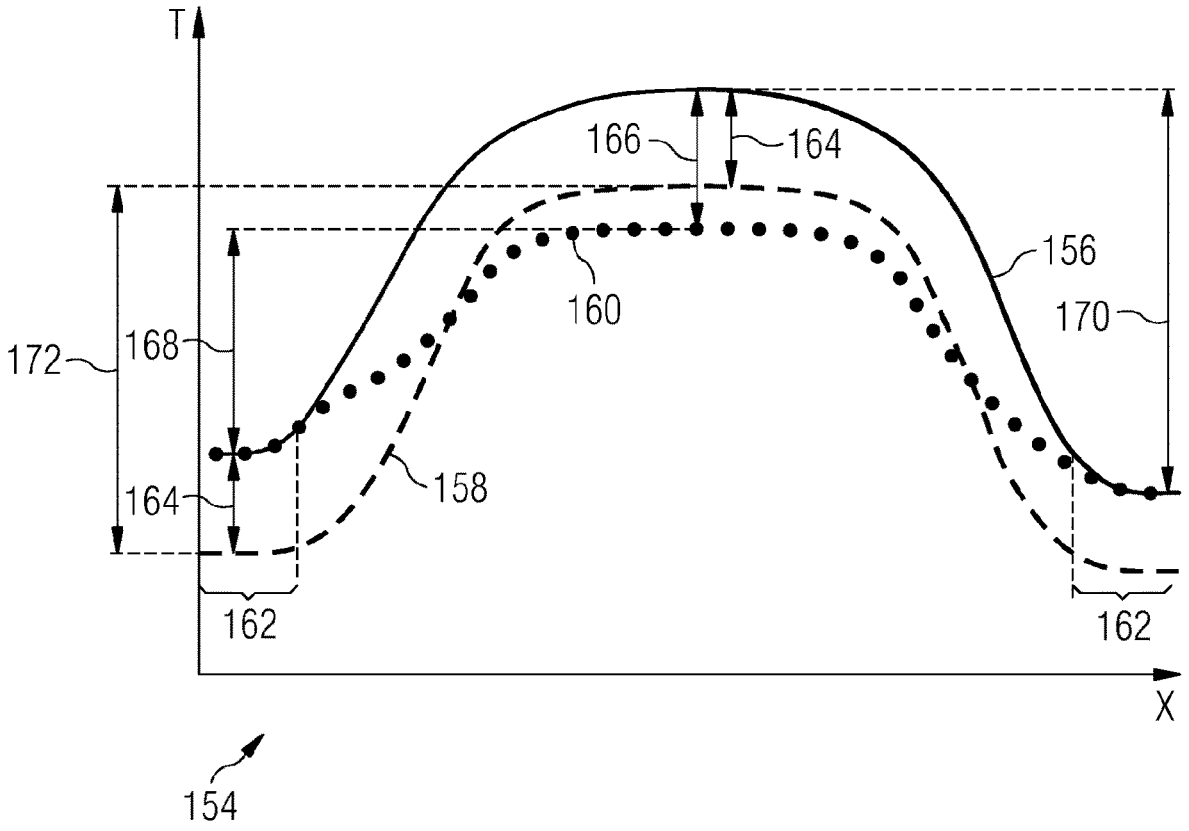
FIG. 16 is a schematic graph depicting a temperature profile of the surface temperature of section B-B, shown in FIG. 5, of a wall of the transition duct.

FIG. 16 is a schematic graph depicting a temperature profile 154 of the surface temperature along section B-B, shown in FIG. 5, of the wall 51 of the transition duct 17. Profile line 156 represents the temperature of the surface 54 of the transition duct without thermal barrier coating. Profile line 158 represents the temperature of the surface of the transition duct 17 with a uniform thickness thermal barrier coating applied over the entire internal surface. Profile line 160 represents the temperature of the surface of a transition duct 17 with a varying thickness thermal barrier coating 100 applied in accordance with the present invention and as described herein.

For the uniform thermal barrier coating case its temperature profile line 158 is shown as reducing the temperature of the surface 54 by a uniform amount and as shown by temperature difference 164 between the profile lines 156 and 158. The temperature difference 164 is constant along the entire temperature profile 154 graph. The temperature range 168, between maximum and minimum temperatures, along the profile 158 is the same as a temperature range 170 of the uncoated surface 54. Thus the temperature gradient along the surface 54 remains the same with or without the uniform thermal barrier coating. As can be seen the temperature profile 160

In contrast, for the varying thickness thermal barrier coating 100, the temperature difference between the profile lines 156 and 160 varies between zero, in regions 161, and a maximum 166. In regions 162 there is no thermal barrier coating 100. The maximum 166 temperature difference does not necessarily occur where the thickest portion of thermal barrier coating is applied. Thus the temperature difference 168 and hence temperature gradient across the wall is greatly reduced. Hence, the varying thickness thermal barrier coating 100 significantly reduces stresses and strains throughout the transition duct 17. Furthermore, the peak maximum temperature of the surface is also reduced.

Another aspect of the present invention is a method of forming the transition duct 17 having the depressions 84 as described with particular reference to FIGS. 8-11. In the same way as described above, the first isotherm 73 and the second isotherm 75 locations are determined. For the embodiments relating to FIGS. 8 and 9, where there is a step 86, 88 the isotherm contours or lines 73, 75 are used to denote their location. The step or steps are then formed by pressing or stamping the sheet metal wall to form the depression 84. Similarly, where a smooth profile 98 rather than the stepped profile is used as shown in FIGS. 10 and 11, hydroforming may be used to create the smooth profile 98. Other known techniques can be employed, however, the key to this method is the location of the isotherms to create the locations for the depths relative to the nominal surface profile 90 as described above.

It should be appreciated that throughout the above description of the present invention variable thicknesses of thermal barrier coating, two barrier coating thicknesses, two steps, two minimum depths or thickness or patches or areas have been described; however, the present invention encompasses any number of these parameters and with a view to achieving the same advantages. For example, the variable thicknesses of thermal barrier coating may include three, four or more patches of thermal barrier coatings that have different thicknesses. Furthermore, whereas the exemplary embodiments show increasing thickness of thermal barrier coating in the downstream direction with respect to the general flow of the combustions gases 34, the thermal barrier coating may decrease in thickness in the downstream direction or in a lateral direction.

In some examples, to which the present invention is applicable and includes, the transition duct may be constituted by an extended or elongated combustor can 19 and a separate duct located between the combustor can 19 and the turbine 18. Thus the term 'transition duct' used herein comprises the duct itself as well as the duct and the extended combustor can.

While the invention has been illustrated and described in detail for a preferred embodiment the invention is not limited to these disclosed examples and other variations can be deduced by those skilled in the art in practicing the claimed invention.

The invention claimed is:

1. A gas turbine engine comprising:

a combustor, a turbine and a transition duct, wherein the transition duct is located between the combustor and the turbine to channel hot gas from the combustor to the turbine, wherein the transition duct comprises an internal surface on which the hot gas impinges to cause a varying temperature profile that forms a plurality of isotherms over the internal surface, a thermal barrier coating which is located on the internal surface and comprises at a first thermal barrier coating patch and a second thermal barrier coating patch, wherein the first thermal barrier coating patch: comprises a first thickness that is constant; is located on the internal surface; spans a plurality of relatively lower temperature isotherms of the plurality of isotherms; and is bounded by a first patch boundary that follows a coolest isotherm of the plurality of relatively lower temperature isotherms during operation, and wherein the second thermal barrier coating patch: comprises a second thickness that is constant and thicker than the first thickness; is located on the internal surface, spans a plurality of relatively higher temperature isotherms of the plurality of isotherms during the operation, and is bounded by a second patch boundary that follows a coolest isotherm of the plurality of relatively higher temperature isotherms during the operation.

2. The gas turbine engine as claimed in claim 1, wherein the first thickness is a first minimum thickness and is disposed over the coolest isotherm of the plurality of relatively lower temperature isotherms, and/or the second thickness is a second minimum thickness and is disposed over the coolest isotherm of the plurality of relatively higher temperature isotherms.

3. The gas turbine engine as claimed in claim 1, wherein the thermal barrier coating comprises a transition portion connecting the first thermal barrier coating patch to the second thermal barrier coating patch, the transition portion comprising a varying thickness.

4. The gas turbine engine as claimed in claim 1, wherein the thermal barrier coating comprises a step.

5. The gas turbine engine as claimed in claim 4, wherein the step comprises a riser that creates a transition in a thickness of the thermal barrier coating, and the transition in the thickness defines the first patch boundary or the second patch boundary.

6. The gas turbine engine as claimed in claim 5, wherein the riser is disposed at the first patch boundary, and wherein a combustion-gas-washed surface of the first thermal barrier coating patch is flush with a nominal profile of an uncoated part of the internal surface directly adjacent the first thermal barrier coating patch.

7. The gas turbine engine as claimed in claim 5, wherein a combustion-gas-washed surface of the first thermal barrier coating patch and a combustion-gas-washed surface of the second thermal barrier coating patch are flush with a nominal profile of an uncoated part of the internal surface directly adjacent the first thermal barrier coating patch.

8. The gas turbine engine as claimed in claim 1, wherein the transition duct comprises a depression and at least a part of the thermal barrier coating is located within the depression.

9. The gas turbine engine as claimed in claim 8, wherein the depression comprises at least one step and at least one of the first thermal barrier coating patch and the second thermal barrier coating patch is located on the at least one step.

10. The gas turbine engine as claimed in claim 8, wherein the depression comprises a first step and a second step and the first thermal barrier coating patch is located on the first step and the second thermal barrier coating patch is located on the second step.

11. The gas turbine engine as claimed in claim 10, wherein the transition duct forms a combustion-gas-washed surface defined partly by the internal surface and partly by the thermal barrier coating, and the combustion-gas-washed surface is smooth and uninterrupted.

12. The gas turbine engine as claimed in claim 8, wherein the thermal barrier coating comprises a transition portion connecting the first thermal barrier coating patch to the second thermal barrier coating patch, the transition portion comprising a varying thickness, wherein the depression comprises a smooth profile comprising a curved portion and the transition portion is located on the curved portion of the smooth profile.

13. The gas turbine engine as claimed in claim 8, wherein the depression comprises a first depth equal to the first thickness where the first thermal barrier coating patch is disposed.

14. The gas turbine engine as claimed in claim 8, wherein the depression comprises:

a first step comprising a riser that establishes a first depth equal to the first thickness where the first thermal barrier coating patch is disposed, and a second step directly adjacent the first step and comprising a second riser that establishes a second depth equal to the second thickness where the second thermal barrier coating patch is disposed.

15. A method of manufacturing a transition duct for a gas turbine engine, the transition duct comprises an internal surface on which hot gas impinges to cause a varying temperature profile over the internal surface, the method comprising:

determining a plurality of isotherms on the internal surface during operation, applying a thermal barrier coating on the internal surface which comprises a first thermal barrier coating patch and a second thermal barrier coating patch, applying the first thermal barrier coating patch on the internal surface, wherein the first thermal barrier coating patch: comprises a first thickness that is constant; spans a plurality of relatively lower temperature isotherms of the plurality of isotherms; and is bounded by a first patch boundary that follows a coolest isotherm of the plurality of relatively lower temperature isotherms, applying a second thermal barrier coating patch on the internal surface, wherein the second thermal barrier coating patch: comprises a second thickness that is constant and thicker than the first thickness; spans a plurality of relatively higher temperature isotherms of the plurality of isotherms; and is bounded by a second patch boundary that follows a coolest isotherm of the plurality of relatively higher temperature isotherms.

16. The method of manufacturing the transition duct as claimed in claim 15, wherein the method further comprises:

forming a depression in the transition duct, and applying at least one of the first thermal barrier coating patch or the second thermal barrier coating patch in the depression.

17. The method of manufacturing the transition duct as claimed in claim 16, wherein the depression comprises at least one step and at least one of the first thermal barrier coating patch and the second thermal barrier coating patch is located on the at least one step.

18. The method of manufacturing the transition duct as claimed in claim 16, wherein the depression comprises a first step and a second step and the first thermal barrier coating patch is located on a the first step and the second thermal barrier coating patch is located on a trod of the second step.

19. The method of manufacturing the transition duct as claimed in claim 16, applying a transition portion of the thermal barrier coating that connects the first thermal barrier coating patch to the second thermal barrier coating patch, the transition portion comprising a varying thickness, wherein the depression comprises a smooth profile comprising a curved portion, the transition portion is located on the curved portion of the smooth profile.

* * * * *